US005338632A

United States Patent [19]

Hashimoto et al.

[11] Patent Number: 5,338,632

[45] Date of Patent: Aug. 16, 1994

[54] ELECTROPHOTOGRAPHIC PHOTOSENSITIVE MEMBER AND ELECTROPHOTOGRAPHIC DEVICE USING THE SAME

[75] Inventors: Yuichi Hashimoto, Tokyo; Shoji Amamiya, Sagamihara; Teigo Sakakibara, Tokyo, all of Japan

[73] Assignee: Canon Kabushiki Kaisha, Tokyo, Japan

[21] Appl. No.: 985,438

[22] Filed: Dec. 3, 1992

Related U.S. Application Data

[63] Continuation of Ser. No. 591,761, Oct. 2, 1990, abandoned.

[30] Foreign Application Priority Data

Oct. 2, 1989 [JP] Japan ..... 1-255324

[51] Int. Cl.[5] ..... G03G 15/02

[52] U.S. Cl. ..... 430/58; 430/57; 136/263

[58] Field of Search ..... 430/57, 58, 96; 136/263

[56] References Cited

U.S. PATENT DOCUMENTS

| | | | |
|---|---|---|---|
| 4,701,395 | 10/1987 | Wronski | 430/58 |
| 4,859,553 | 8/1989 | Jansen et al. | 430/58 |
| 4,882,257 | 11/1989 | Maruyama et al. | 430/100 |
| 4,920,022 | 4/1990 | Sakakibara et al. | 430/59 |
| 4,963,196 | 10/1990 | Hashimoto et al. | 136/257 |

FOREIGN PATENT DOCUMENTS

| | | |
|---|---|---|
| 59-32788 | 2/1984 | Japan . |
| 63-240554 | 10/1988 | Japan . |

*Primary Examiner*—Steve Rosasco

*Attorney, Agent, or Firm*—Fitzpatrick, Cella, Harper & Scinto

[57] ABSTRACT

An electrophotographic photosensitive member comprises a light-transmissive electroconductive substrate and a photosensitive layer on said substrate, said photosensitive layer comprising a charge generating material and a charge transporting material, the number of the photoconductive carriers formed by said charge generating material and said substrate being more than the number of the photoconductive carriers formed by said charge generating material and said charge transporting material.

15 Claims, 7 Drawing Sheets

ELECTROPHOTOGRAPHIC PHOTOSENSITIVE MEMBER AND ELECTROPHOTOGRAPHIC DEVICE USING THE SAME

This application is a continuation of application Ser. No. 07/591,761 filed Oct. 2, 1990, now abandoned.

BACKGROUND OF THE INVENTION

1. Field of the Invention

This invention relates to an electrophotographic photosensitive member and an electrophotographic device, particularly to an electrophotographic photosensitive member utilizing the work function difference between an electroconductive support and a charge generating material, and an electrophotographic device using the photosensitive member.

2. Related Background Art

Generally speaking, electrophotographic photosensitive members of the Carlson type can be classified broadly into the so called lamination type comprising a charge generating layer containing a charge generating material and a charge transporting layer containing a charge transporting material laminated on one another, and the so called single layer type containing a charge generating material and a charge transporting material in a single layer under mixed state. In the prior art, in both of these photosensitive members, for generation of photoconductive carriers, photoconductive carriers excited by the work function difference between the charge generating material and the charge transporting material and irradiation of light have been separated and injected through the interaction between the work function difference and the electrical field applied. Choice of the charge generating material and the charge transporting material is very difficult, and it has not been necessarily possible to obtain a photosensitive member having good electrophotographic characteristics.

Also, for preparing an electrophotographic photosensitive member having good sensitivity over a wide wavelength region, it has been proposed to provide a charge generating layer in which two or more kinds of charge generating materials are mixed or laminate several kinds of charge generating layers, as described in Japanese Patent Application Laid-Open No. 59-32788. However, in the case of such photosensitive members, because plural kinds of charge generating materials are employed, it becomes further difficult to control the carrier movement between the respective charge generating materials than in the case of using a single kind of charge generating material, and they had the drawback of being unstable with respect of potential stability.

SUMMARY OF THE INVENTION

An object of the present invention is to provide an electrophotographic photosensitive member having good electrophotographic characteristics.

Another object of the present invention is to provide an electrophotographic photosensitive member of which the charge generating material and the charge transporting material can be chosen easily.

More specifically, the present invention is an electrophotographic photosensitive member, comprising a light-transmissive electroconductive substrate and a photosensitive layer on said substrate, said photosensitive layer comprising a charge generating material and a charge transporting material, the number of the photoconductive carriers formed by said charge generating material and said substrate being more than the number of the photoconductive carriers formed by said charge generating material and said charge transporting material, and an electrophotographic device by use thereof.

DETAILED DESCRIPTION OF THE PREFERRED EMBODIMENTS

According to the present invention, by utilizing the work function difference at the interface between the electroconductive support and the charge generating material, a large number of photoconductive carriers can be generated in the vicinity of the interface between the two of them, and it has also become possible to effect injection of carriers from the charge generating material to the charge transporting material through the work function difference between the both.

Also, the present invention provides an electrophotographic photosensitive member which can be used not only for a process which performs exposure for image formation from the photosensitive layer side as generally practiced in the prior art or a process which performs exposure from the electroconductive support side as described in Japanese Patent Application Laid-Open No. 63-240554, as a matter of course, but also for an entirely new process which performs exposure #or image formation from the electroconductive support side and the photosensitive layer side.

Next, the photoconductive mechanism of the electrophotographic photosensitive member of the present invention is described by referring to drawings.

First, the case when the work function difference between the charge generating layer and the charge transporting layer is not sufficient is considered.

Figure 1A:
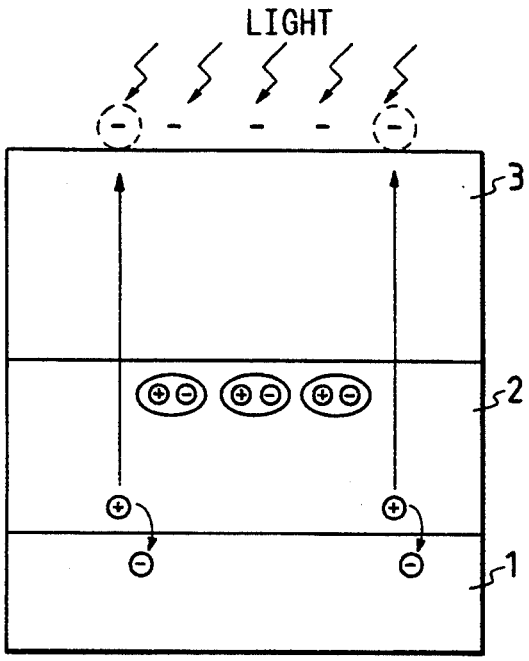
FIGS. 1A and 1B, and FIGS. 3A and 3B show schematic sectional views of the photosensitive member of the present invention.
Figure 1B:
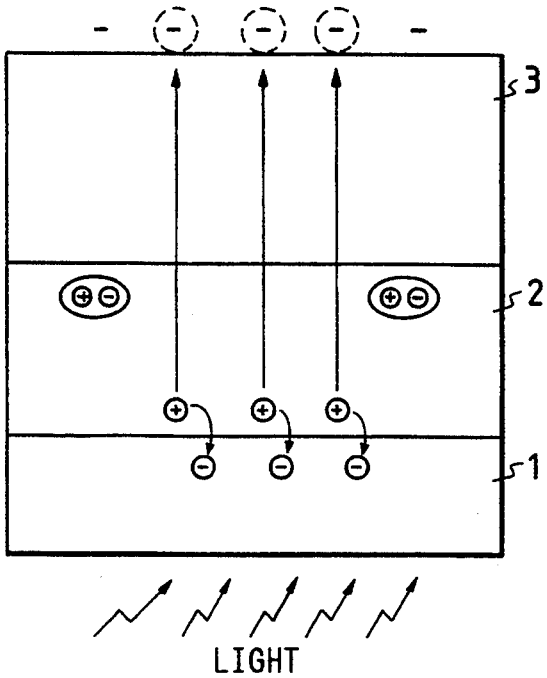

FIGS. 1A and 1B show the cases when negative charging is applied on an electrophotographic photosensitive member provided successively with a charge generating layer 2 and a charge transporting layer 3 on a light-transmissive support 1, and light is irradiated from the charge transporting layer side and the electroconductive support side, respectively.

When light is irradiated from the charge transporting layer 3 side as shown in FIG. 1A, the light in the wavelength region in which the charge generating layer 2 has high light absorbance can be strongly absorbed on a portion of the charge generating layer 2 or the charge transporting layer 3 side, but because the work function difference between the two layers is not sufficient, no photoconductive carrier formation can be achieved. The light in the wavelength region in which the charge generating layer 2 has low light absorbance can reach easily the interface between the electroconductive support 1 and the charge generating layer 2, whereby photoconductive carriers are formed through the work function difference between the two.

On the other hand, when light is irradiated from the electroconductive 1 side as shown in FIG. 1B, the light in the wavelength region in which the charge generating layer 2 has high light absorbance is absorbed strongly on a portion of the charge generating layer 2 on the electroconductive support side 1, and the photoconductive carriers are formed through the work function difference between the two.

The light in the wavelength region in which the charge generating layer 2 has low light absorbance reaches the interface between the charge transporting layer 3 and the charge generating layer 2, but the work function difference between the two is not sufficient, whereby no photoconductive carrier will be formed.

Figure 2:
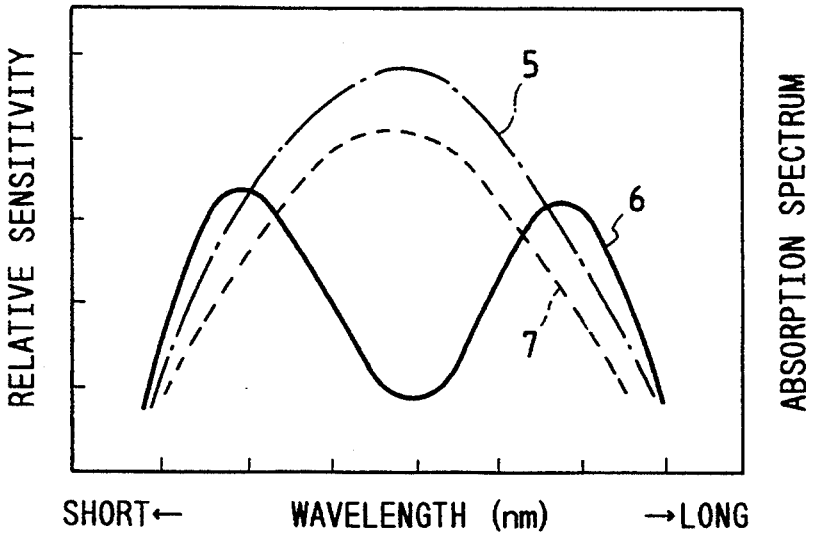
FIG. 2 and FIG. 4 are graphs exhibiting the relationship between the relative sensitivity and the wavelength observed when light is irradiated on said photosensitive member.

The relationship between the sensitivity in tile case of FIG. 1A, the sensitivity in the case of FIG. 1B and tile absorption spectrum, and the wavelength are shown in FIG. 2.

In FIG. 2 and FIGS. 4 and 7 to 12, numeral 5 denotes sensitivity when light is irradiated from the electroconductive support side, 6 sensitivity when irradiated from the charge transporting layer side, and 7 light absorption spectrum of the charge generating layer.

Next, the case when slight photoconductive carriers are formed through the work function difference between the charge generating material and the charge transporting material is described.

Figure 3A:
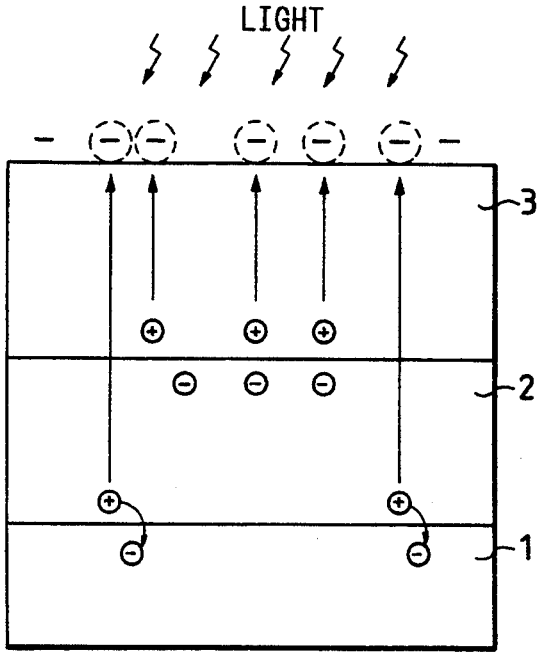
Figure 3B:
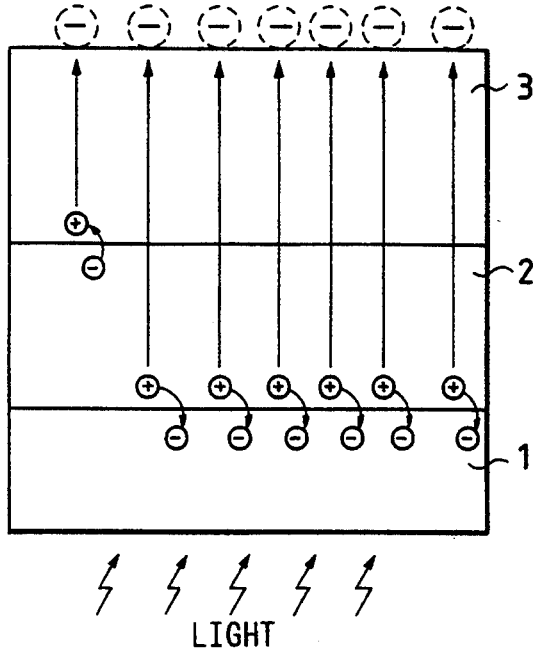

FIGS. 3A and 3B show the case when negative charging is applied on an electrophotographic photosensitive member provided successively with a charge generating layer 2 and a charge transporting layer 3 on an electroconductive support 1, and light is irradiated from the charge transporting layer 3 side and the electroconductive support 1 side, respectively.

Figure 4:
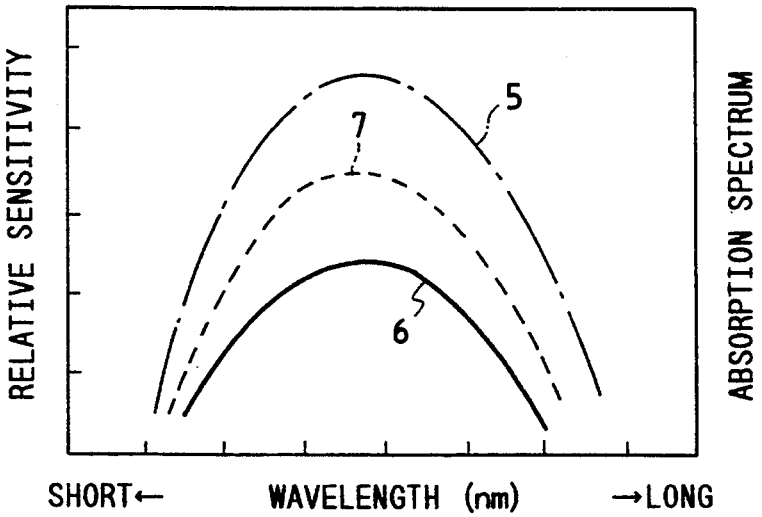

As shown in FIG. 3B, photoconductive carriers are formed at higher efficiency in the case of irradiating light from the electroconductive support 1 side than in the case of irradiating light from the charge transporting 3 side as shown in FIG. 3A, whereby high relative sensitivity can be realized. These situations are shown in FIG. 4.

Thus, by effecting exposure for image formation from the light-transmissive electroconductive support 1 side without damaging the form of spectral sensitivity spectrum, higher sensitization can be also effected.

As described above, the electrophotographic photosensitive member of the present invention generates photoconductive carriers in the vicinity of the interface between the electroconductive support and the charge generating material by utilizing the work function difference therebetween.

Therefore, for generating efficiently photoconductive carriers, the work function difference should be preferably as large as possible, and a work function difference of 0.3 [eV] or higher, further 0.5 [eV] or higher is preferable.

In the present invention, since most of photoconductive carriers are generated in the vicinity of the interface between the electroconductive support and the charge generating material, electrons in the case of positive charging, and positive holes in the case of negative charging must move quickly between the charge generating materials.

If photoconductive carriers are trapped in the layer or extinguished by recombination, harmful effects are exerted on potential stability such as sensitivity, photomemory, etc., and therefore the product of the mobility of electrons or positive holes [$cm^2/V.sec$] and life[sec.] may be preferably $1\times10^{-10}$ [$cm^2/V$] or higher, particularly $1\times10^{-8}$ [$cm^2/V$] or higher.

When the photosensitive member of the present invention is used for an electrophotographic process in which the primary charging is negative charging, if the work function of the charge generating material is larger than that of the electroconductive support, the work function difference between the two works so as to obstruct injection of positive holes from the electroconductive support to the charge generating material, whereby lowering in dark portion potential can be also inhibited.

The electrophotographic photosensitive member of the present invention can be subjected to image exposure by known methods by use of fluorescent lamp, xenon lamp, halogen light source, tungsten lamp, semiconductor laser, gas laser or LED, etc. as the light source. Particularly, the electrophotographic photosensitive member of the present invention having the spectral sensitivity spectrum as shown in FIG. 2 is a kind of bi-peak photosensitive member, and can be used for an electrophotographic device in which lights from different light sources are irradiated from the light-transmissive electroconductive side and the charge transporting layer side.

For example, the electrophotographic photosensitive member shown in FIG. 2 can be used for a new electrophotographic process, in which image exposure by a semiconductor laser from the charge transporting layer side and image exposure by a halogen light from the light-transmissive support side are effected at the same time or separately.

In the present invention, the photosensitive layer may be either of the lamination type in which the charge generating layer and the charge transporting layer are separated in function from each other or of the singly layer type in which the both exist mixed with each other.

In the case of the lamination type photosensitive layer, the charge generating layer can be formed by coating a dispersion containing a charge generating material, including azo pigments such as Sudan Red, Dianblue, etc., quirtone pigments such as pyrenequinone, anthanthrone, etc., quinocyanine pigments, perylene pigments, indigo pigments such as indigo, thioindigo, etc., azulenium salt pigments, phthalocyanine pigments such as copper phthalocyanine, etc. in a binder resin such as polyvinyl butyral, polystyrene, polyvinyl acetate, acrylic resin, polyvinyl pyrrolidone, ethyl cellulose, cellulose acetate-butyrate, etc.

Of course, the charge generating material must have the relationship satisfying claim 1 with the electroconductive support as described below.

The film thickness of the charge generating layer may be preferably 5 μm or less, more preferably 0.05 to 2 μm.

The charge transporting layer can be formed by use of a coating solution of a charge transporting material, including a polycyclic aromatic compound having a structure such as biphenylene, anthracene, pyrene, phenanthrene in the main chain or the side chain, a nitrogen containing heterocyclic compound such as indole, carbazole, oxadiazole, pyrazoline, etc., a hydrazone compound, a styryl compound, etc., dissolved in a resin having film forming property, if desired.

As such resin having film forming property, polyester, polycarbonate, polymethacrylate, polystyrene, may be included.

The thickness of the charge transporting layer may be preferably 5 to 40 μm, more preferably 10 to 30 μm.

The photosensitive layer in the case of the single layer type can be formed by incorporating a charge generating material and a charge transporting material as described above in the resin.

On the other hand, the electroconductive support may be any material, provided that it has a transparency which does not interfere with light absorption of the charge generating material to be used in the present invention, also has electroconductivity and further satisfies the relationship of wherein the number of the photoconductive carriers formed by said charge generating material and said substrate is more than the number of the photoconductive carriers formed by the charge generating material and the charge transporting material. The electroconductive support is as exemplified by a material having aluminum, gold, silver, chromium, nickel, zinc, lead, copper iodide, indium oxide, tin oxide, etc. vapor deposited, for example, on a plastic film, or a plastic film having an electroconductive layer provided with an electroconductive substance alone or together with a suitable binder resin.

The shape of the support may be either a sheet or a drum.

Also, in the present invention, an intermediate layer having the function of adhesion can be provided between the electroconductive support and the photosensitive layer. Thus, even by provision of an intermediate layer between the electroconductive support and the photosensitive layer, no deleterious influence can be seen in electrophotographic characteristics.

As the resin to be used for the intermediate layer, there may be included thermoplastic resins such as polyamide, polyester, acrylic resin, polyamino acid ester, polyvinyl acetate, polycarbonate, polyvinyl formal, polyvinyl butyral, polyvinyl alkyl ether, polyalkylene ether, polyurethane elastomer, etc., thermosetting resins such as thermosetting polyurethane, phenolic resin, epoxy resin, etc. The film thickness of the intermediate layer may be preferably 0.1 to 10.0 μm, more particularly 0.5 to 5.0 μm.

Also in the present invention, a protective layer can be further laminated on the photosensitive layer. Generally, as the protective layer, a resin layer or a resin layer containing electroconductive particles dispersed therein can be employed.

The respective layers can be formed by coating, and as the method for coating, known techniques such as the dip coating method, the spray coating method, the roll coating method, etc. may be included.

Figure 5:
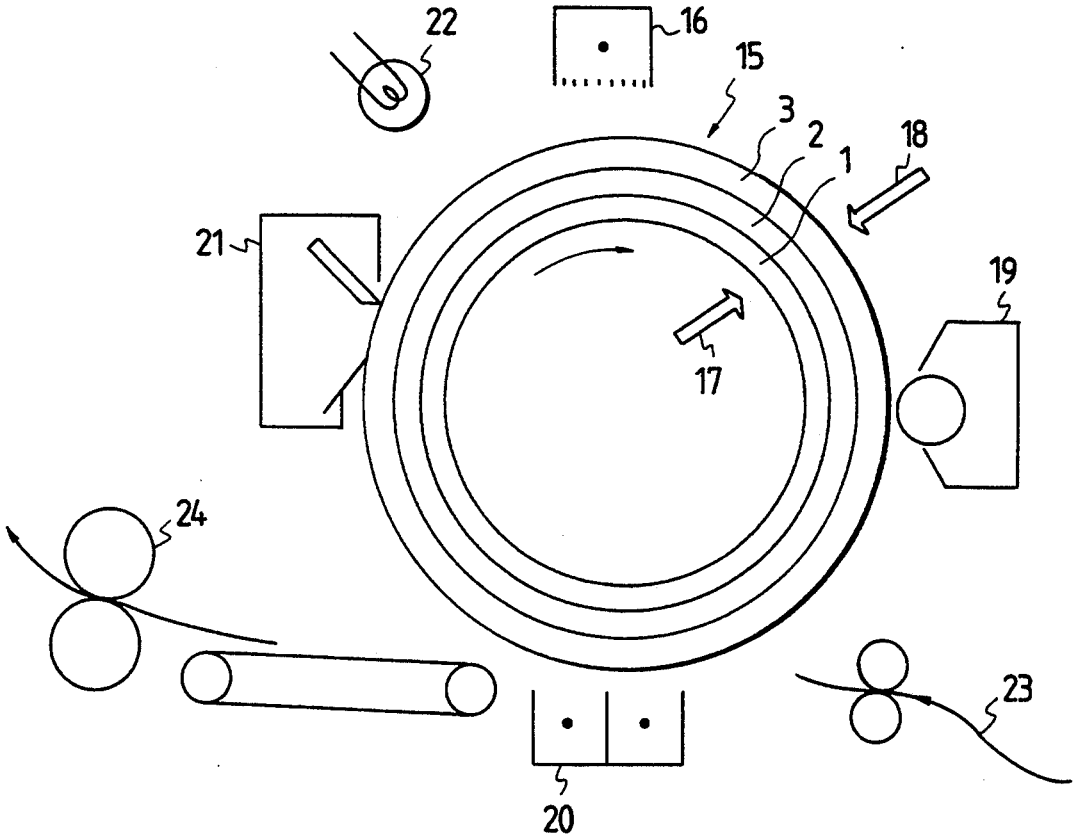
FIG. 5 shows an example of a sectional view of the electrophotographic device using the photosensitive member of the present invention.

In the following, an example of the image forming process of the electrophotographic device by use of the electrophotographic photosensitive member of the present invention (FIG. 5) is described.

After the photosensitive member 15 is negatively charged by the primary charger 16, image exposure from the inside of the halogen light source 17 and the conventional image exposure by the semiconductor laser beam 18 are performed simultaneously to form a latent image.

Further, a positive toner is attached onto the photosensitive member 15 by tile developing instrument 19, and after transfer by means of the transfer charger 20 onto a plain paper, the image is fixed by means of the fixing instrument 24.

Other than performing thus simultaneously two different kinds of exposure, it is also possible to effect image formation by one developing instrument or a plurality of developing instruments according to the system in which a plurality of different exposures are performed simultaneously or successively. Referring now to specific examples, the present invention is described in more detail.

EXAMPLES 1-3 AND COMPARATIVE EXAMPLES 1-2

On a polyethylene terephthalate (PET) film with a thickness of 50 μm was vapor deposited aluminum, copper iodide or tin oxide each to a film thickness of 500 Å so as to have translucency and electroconductivity to provide electroconductive supports of Examples 1-3. Also, nickel, platinum was similarly deposited to provide electroconductive supports of Comparative examples 1-2.

Next, 4 parts of a compound represented by the following structural formula:

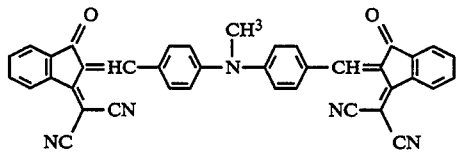

2 parts of a bisphenol Z type polycarbonate (weight average molecular weight 25000) and 34 parts of cyclohexanone were mixed and dispersed in a sand mill containing glass beads of 1 mm in diameter for 20 hours, followed by addition of 60 parts of methyl ethyl ketone to prepare a dispersion for charge generating layer. The dispersion was coated by a wire bar on each electroconductive support as described above, and dried at 80° C. for 15 minutes to prepare a charge generating layer with a film thickness of 0.20 μm.

Next, 10 parts of a styryl compound represented by the following structural formula:

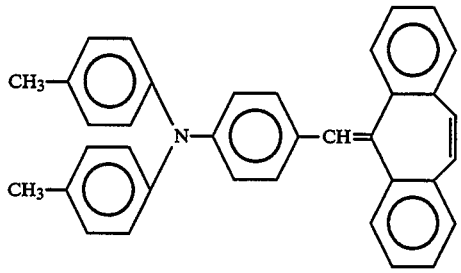

and 10 parts of a bisphenol Z type polycarbonate (weight average molecular weight 33000) were dissolved in a solvent mixture of 40 parts of dichloromethane and 20 parts of monochlorobenzene, and the solution was coated by a wire bar on the charge generating layer as described above, followed by drying at 120° C. for 60 minutes to form a charge transporting layer with a film thickness of 25 μm.

Figure 6A:
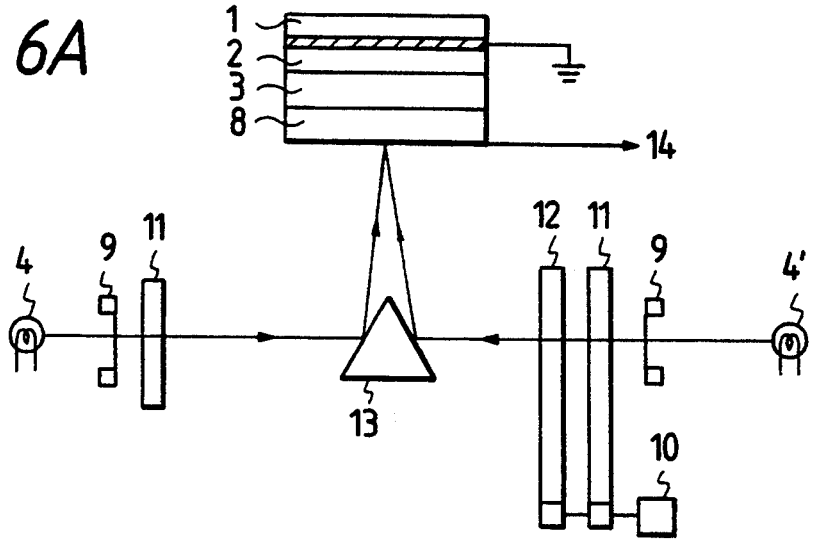
FIGS. 6A and 6B show an example of the constitutional view of the electrophotographic device of the present invention, showing the route of rays and the relative arrangements of related instruments when light is irradiated on the photosensitive member of the present invention from the photosensitive layer side and the electroconductive support side respectively.
Figure 6B:
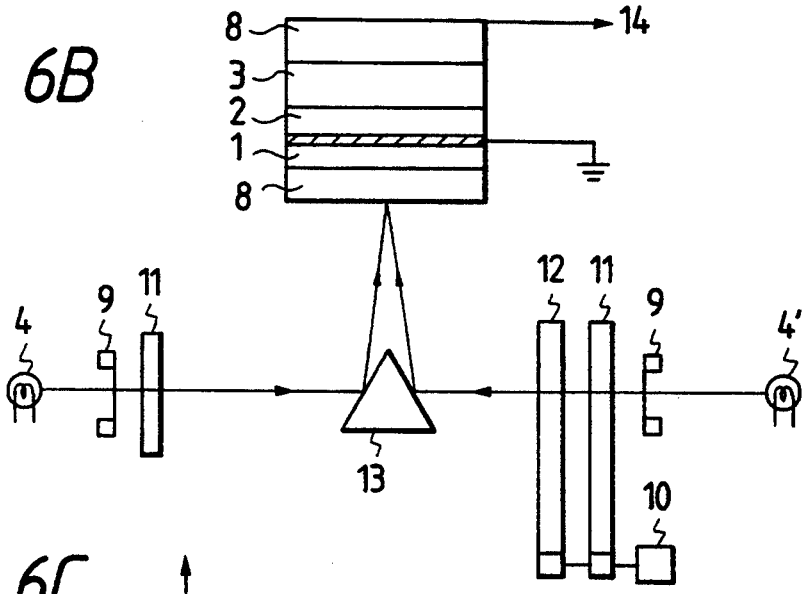
Figure 6C:
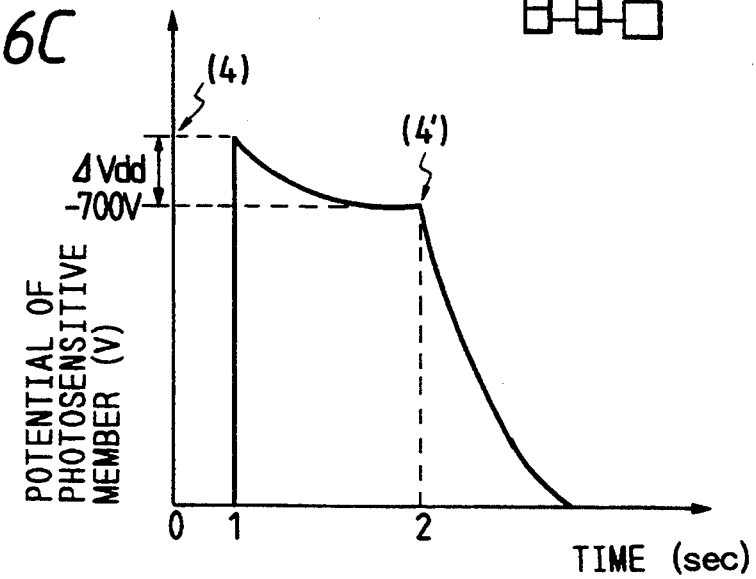
FIG. 6C is a graph showing the change in potential with lapse of time by irradiation of light on the photosensitive member of the present invention after charging.

For the electrophotographic photosensitive member thus prepared, spectral sensitivity and dark decay were measured by means of the measuring machine shown in FIG. 6.

When light is irradiated from the electroconductive support 1 side, tile measuring system of FIG. 6B was employed. First, a voltage is applied from 14 on the photosensitive member, then light from the light source 4 is irradiated for 10 msec., and one sec. later, a voltage is applied. The potential 1 sec. after voltage application is measured as dark decay (Δ Vdd).

Further thereafter, light from the light source 4' is irradiated through an ND filter 11 and an interference filter for 10 msec., and the potential after 500 msec. is measured. For lights with various wavelengths by use of various interference filters, this operation is repeated. The energy of the light with each wavelength is measured (EG & G, MODEL 550), a light quantity-potential graph is prepared and sensitivity ($E_{\frac{1}{2}}$) is determined therefrom.

When light is irradiated from the charge transporting layer 3 side, the same measurement is conducted by use of the measuring system in FIG. 6A. At this time, if light is irradiated from the electroconductive support 1 side, in view of the fact that light is slightly absorbed by the electroconductive support 1, it is necessary to make a correction corresponding thereto.

Figure 7:
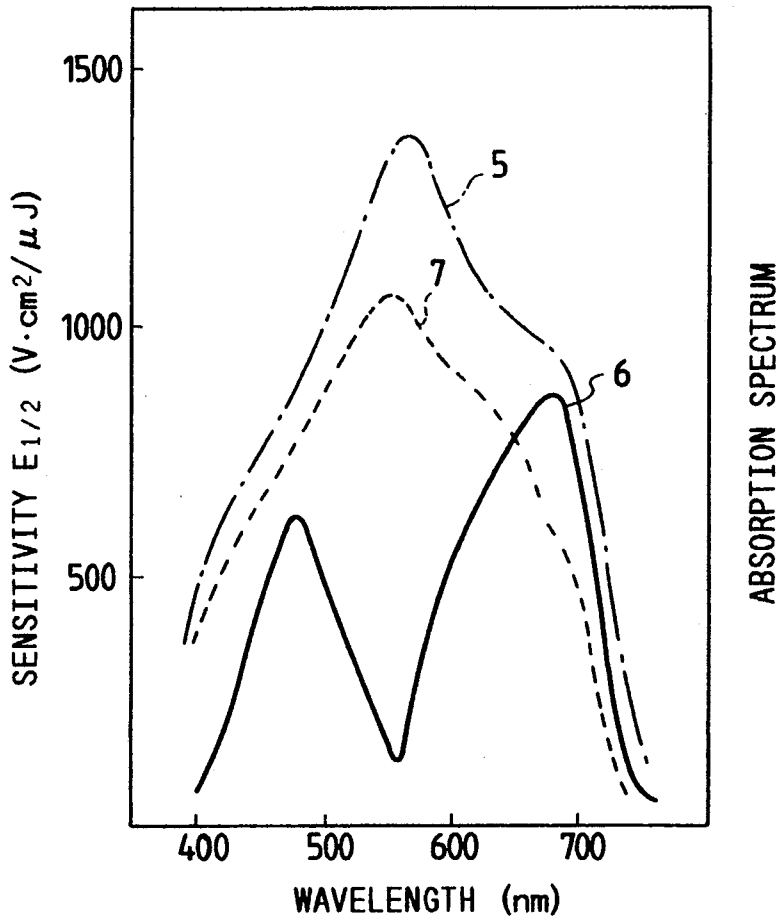

The spectral sensitivity characteristic of the photosensitive member used in Example 1 is shown in FIG. 7, and the results of sensitivity ($E_{\frac{1}{2}}$) and dark decay (Δ Vdd) in Table 1.

Also, by means of a surface analyzer (Riken Keiki, Model AC-1), the work functions of the charge generating material and each electroconductive support were measured. As the result, the work function of the charge generating material is 5.5 [eV], and the work functions of the respective electroconductive supports are as shown in Table 1.

As can be seen from Table 1, one having a difference of 0.5 [eV] or more in work function between the charge generating material and the electroconductive support is also small in dark decay, having a bi-peak type spectral sensitivity and also high sensitivity.

EXAMPLES 4–6 COMPARATIVE EXAMPLES 3–4

On PET film with a thickness of 50 μm was vapor deposited aluminum, zinc or indium oxide each to a film thickness of 500 Å so as to have translucency and electroconductivity to provide electroconductive supports of Examples 4–6. Also, titanium oxide, copper were similarly deposited to provide electroconductive supports of Comparative examples 3–4.

Next, 4 parts of a compound represented by the following structural formula:

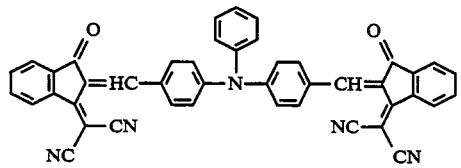

2 parts of a bisphenol Z type polycarbonate (weight average molecular weight 25000) and 34 parts of cyclohexanone were mixed and dispersed in a sand mill containing glass beads of 1 mm is diameter for 20 hours, followed by addition of 60 parts of tetrahydrofuran (THF) to prepare a dispersion for charge generating layer. The dispersion was coated by a wire bar on each electroconductive support as described above, and dried at 80° C. for 15 minutes to prepare a charge generating layer with a film thickness of 0.18 μm.

Next, 10 parts of the styryl compound used in Example 1 and 10 parts of a bisphenol Z type polycarbonate (weight average molecular weight 33000) were dissolved in a solvent mixture of 40 parts of dichloromethane and 20parts of monochlorobenzene, and the solution was coated by a wire bar on the charge generating layer as described above, followed by drying at 120° C. for 60 minutes to form a charge transporting layer with a film thickness of 25 μm.

Figure 8:
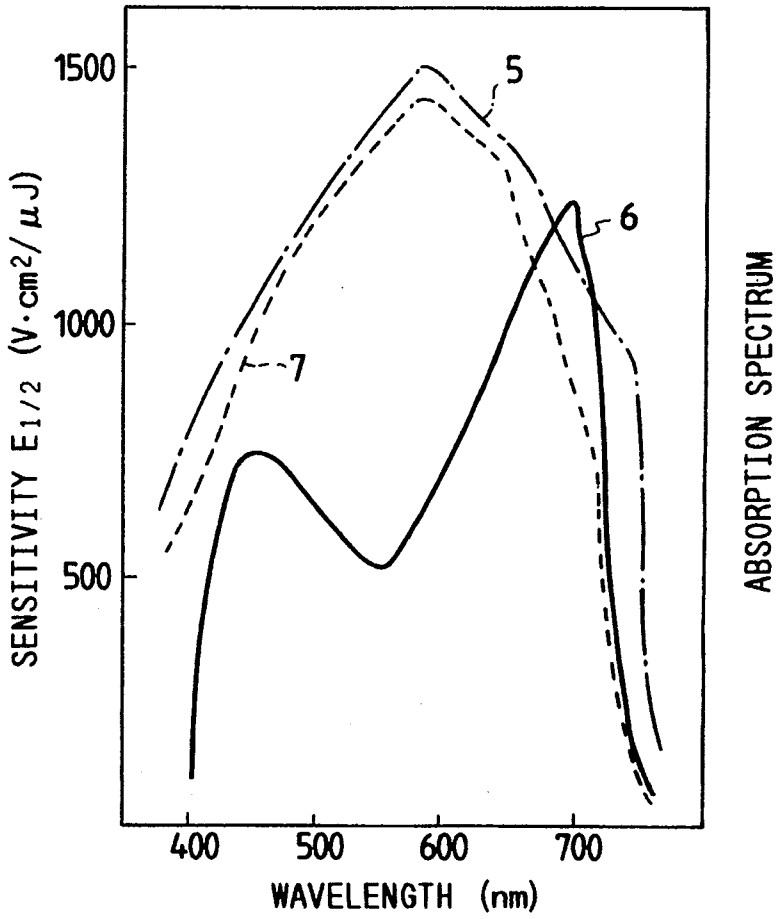
FIGS. 7 to 12 are graphs showing relationships between the spectral sensitivities of the various photosensitive members of the present invention, the absorption spectra of charge generating layers and wavelengths of irradiated light.

For the electrophotographic photosensitive member thus prepared, spectral sensitivity and dark decay (Δ Vdd) were measured similarly as in Example 1. The results of the spectral sensitivity characteristic of Example 4 are shown in FIG. 8, and the results of sensitivity ($E_{\frac{1}{2}}$) and dark decay (Δ Vdd) in Table 2.

Also, by means of a surface analyzer (Riken Keiki, Model AC-1), the work functions of the charge generating material and each electroconductive support were measured. As the result, the work function of the charge generating material is 5.3 [eV], and the work functions of the respective electroconductive supports are as shown in Table 2.

As can be seen from Table 2, in the combination having a difference of 0.5 [eV] or more in work function between the charge generating material and the electroconductive support, dark decay (ΔVdd) is also small, and it has a bi-peak type spectral sensitivity and also high sensitivity.

EXAMPLES 7–9 AND COMPARATIVE EXAMPLES 514 6

On PET film with a thickness of 50 μm was vapor deposited aluminum oxide, indium or tin each to a film thickness of 500 Å so as to have translucency and electroconductivity to provide electroconductive supports of Examples 7–9. Also, gold, tin oxide were similarly deposited to provide electroconductive supports of Comparative examples 5–6.

Next, 4 parts of a compound represented by the following structural formula:

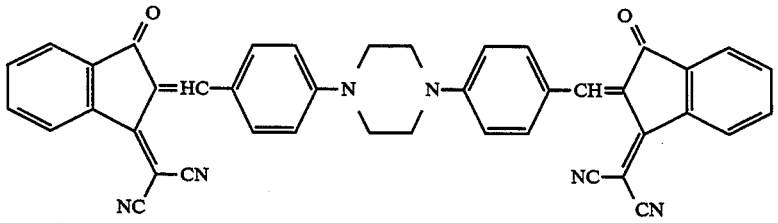

2 parts of a bisphenol Z type polycarbonate (weight average molecular weight 25000) and 34 parts of cyclohexanone were mixed and dispersed in a sand mill containing glass beads of 1 mm in diameter for 20 hours, followed by addition of 60 parts of tetrahydrofuran (THF) to prepare a dispersion for charge generating layer. The dispersion was coated by a wire bar on each electroconductive support as described above, and dried at 80° C. for 15 minutes to prepare a charge generating layer with a film thickness of 0.16 μm.

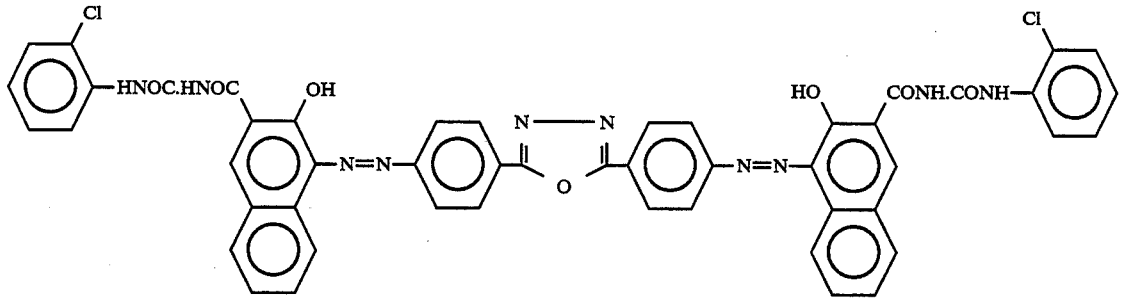

Next, 10 parts of the styryl compound used in Example 1 and 10 parts of a bisphenol Z type polycarbonate (weight average molecular weight 33000) were dissolved in a solvent mixture of 40 parts of dichloromethane and 20 parts of monochlorobenzene, and the solution was coated by a wire bar on the charge generating layer as described above, followed by drying at 120° C. for 60 minutes to form a charge transporting layer with a film thickness of 20 μm.

Figure 9:
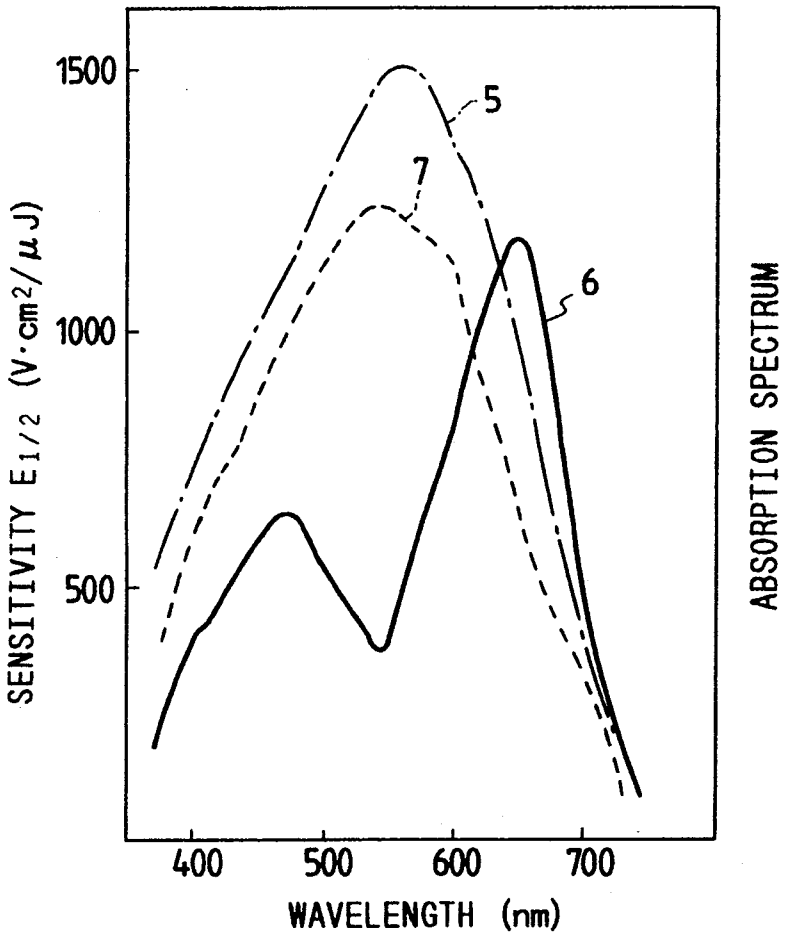

For the electrophotographic photosensitive member thus prepared, spectral sensitivity and dark decay (Δ Vdd) were measured similarly as in Example 1. The results of the spectral sensitivity characteristic of Example 7 are shown in FIG. 9, and the results of sensitivity ($E\frac{1}{2}$) and dark decay (Δ Vdd) in Table 3.

Also, by means of a surface analyzer (Riken Keiki, Model AC-1), the work functions of the charge generating material and each electroconductive support were measured. As the result, the work function of the charge generating material is 5.1 [eV], and the work functions of the respective electroconductive supports are as shown in Table 3.

As can be seen from Table 3, in the combination having a difference of 0.5 [eV] or more in work function between the charge generating material and the electroconductive support, dark decay (Δ Vdd) is also small, and it has a bi-peak type spectral sensitivity and high sensitivity.

EXAMPLES 10–12 AND COMPARATIVE EXAMPLES 7–8

On a PET film with a thickness of 50 μm was vapor deposited aluminum, silver or lead each to a film thickness of 500 Å so as to have translucency and electroconductivity to provide electroconductive supports of Examples 10–12. Also, copper iodide, gold were similarly deposited to provide electroconductive supports of Comparative examples 7–8. Next, a solution of 5 parts of an alcohol soluble nylon resin dissolved in 95 parts of methanol was coated by a wire bar on the above electroconductive support, followed by drying at 80° C. for 20 minutes to form an intermediate layer with a film thickness of 1.5 μm.

Next, 4 parts of a compound represented by the following structural formula:

2 parts of a benzal resin (weight average molecular weight 24000) and 34 parts of cyclohexanone were mixed and dispersed in a sand mill containing glass beads of 1 mm in diameter for 20 hours, followed by addition of 60 parts of tetrahydrofuran (THF) to prepare a dispersion for charge generating layer. The dispersion was coated by a wire bar on each electroconductive support as described above, and dried at 80° C. for 15 minutes to prepare a charge generating layer with a film thickness of 0.18 μm.

Next, 10 parts of the styryl compound used in Example 1 and 10 parts of a bisphenol Z type polycarbonate (weight average molecular weight 33000) were dissolved in a solvent mixture of 40 parts of dichloromethane and 20 parts of monochlorobenzene, and the solution was coated by a wire bar on the charge generating layer as described above, followed by drying at 120° C. for 60 minutes to form a charge transporting layer with a film thickness of 20 μm.

Figure 10:
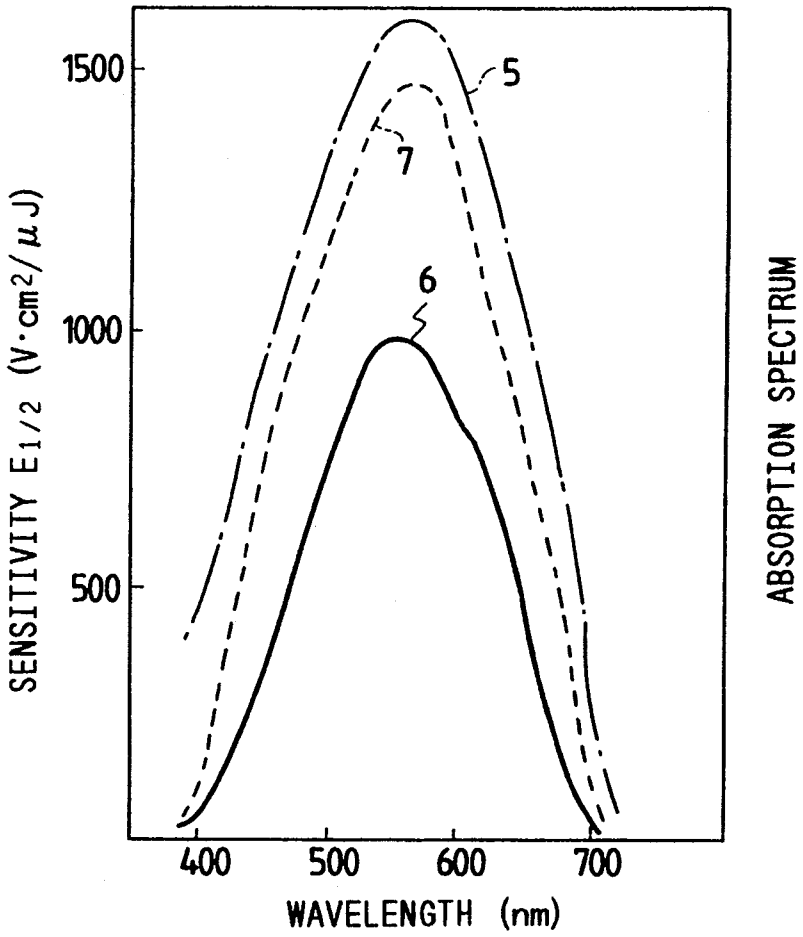

For the electrophotographic photosensitive member thus prepared, spectral sensitivity and dark decay (Δ Vdd) were measured similarly as in Example 1. The results of the spectral sensitivity characteristic of Example 10 are shown in FIG. 10, and the results of sensitivity ($E\frac{1}{2}$) and dark decay (Δ Vdd) in Table 4.

Also, by means of a surface analyzer (Riken Keiki, Model AC-1), the work functions of the charge generating material and cacti electroconductive support were measured. As the result, tile work function of the charge generating material is 5.0 [eV], and the work functions of the respective electroconductive supports are as shown in Table 4.

As can be seen from Table 4, in the combination having a difference of 0.5 [eV] or more in work function between the charge generating material and the electroconductive support, dark decay (Δ Vdd) is small, and higher sensitivity is exhibited when irradiated from the electroconductive support side.

EXAMPLES 13-15 AND COMPARATIVE EXAMPLES 9-10

On a PET film with a thickness of 50 μm was vapor deposited magnesium, manganese or tin oxide each to a film thickness of 500 Å so as to have translucency and electroconductivity to provide electroconductive supports of Examples 13-15.

Also, nickel, platinum were similarly deposited to provide electroconductive supports of Comparative examples 9-10.

Next, 6 parts of a compound represented by the following structural formula:

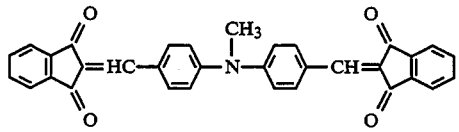

2 parts of a benzal resin (weight average molecular weight 70000) and 44 parts of cyclohexanone were mixed and dispersed in a sand mill containing glass beads of 1 mm in diameter for 40 hours, followed by addition of 60 parts of tetrahydrofuran (THF) to prepare a dispersion for charge generating layer. The dispersion was coated by a wire bar on each electroconductive support as described above, and dried at 80° C. for 15 minutes to prepare a charge generating layer with a film thickness of 0.21 μm.

Next, 10 parts of a hydrazone compound represented by the following formula:

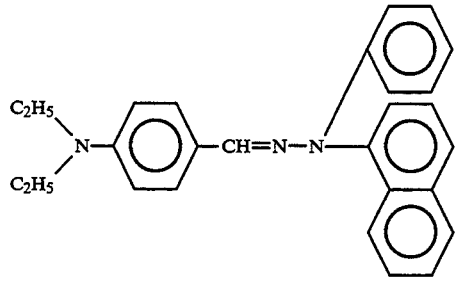

and 10 parts of a bisphenol Z type polycarbonate (weight average molecular weight 39000) were dissolved in a solvent mixture of 40 parts of dichloromethane and 20 parts of monochlorobenzene, and the solution was coated by a wire bar on the charge generating layer as described above, followed by drying at 120° C. for 60 minutes to form a charge transporting layer with a film thickness of 20 μm.

Figure 11:
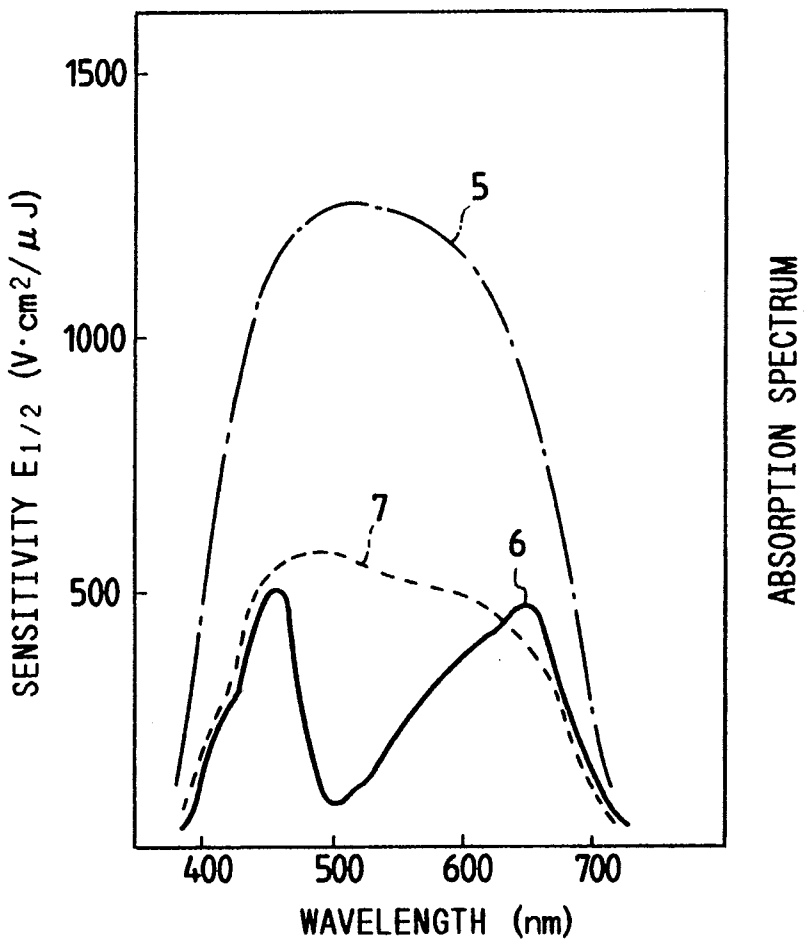

For the electrophotographic photosensitive member thus prepared, spectral sensitivity and dark decay were measured similarly as in Example 1. The results of the spectral sensitivity characteristic of Example 13 are shown in FIG. 11, and the results of sensitivity ($E_{\frac{1}{2}}$) and dark decay (Δ Vdd) in Table 5.

Also, by means of a surface analyzer (Riken Keiki, Model AC-1), the work functions of the charge generating material and each electroconductive support were measured. As the result, the work function of the charge generating material is 5.5 [eV] , and the work functions of the respective electroconductive supports are as shown in Table 5.

As can be seen from Table 5, in the combination having a difference of 0.5 [eV] or more in work function between the charge generating material and the electroconductive support, dark decay (Δ Vdd) is small, and it has a bi-peak type spectral sensitivity and also high sensitivity.

EXAMPLES 16-18 AND COMPARATIVE EXAMPLES 11-12

On a PET film with a thickness of 50 μm was vapor deposited cadmium, iron or indium oxide each to a film thickness of 500 Å so as to have translucency and electroconductivity to provide electroconductive supports of Examples 16-18. Also, antimony, tellurium were similarly deposited to provide electroconductive supports of Comparative examples 11-12.

Next, 5 parts of a compound represented by the following structural formula:

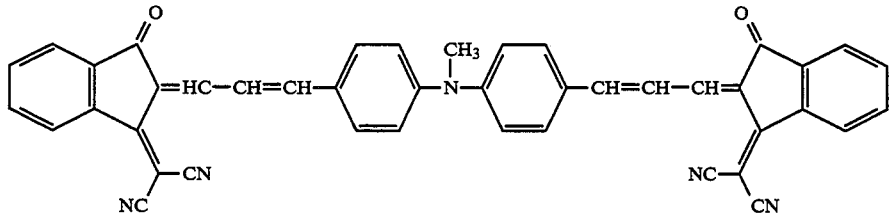

3 parts of a butyral resin (butyral formation degree 60%, weight average molecular weight 55000) and 34 parts of cyclohexanone were mixed and dispersed in a sand mill containing glass beads of 1 mm in diameter for 20 hours, followed by addition of 60 parts of tetrahydrofuran (THF) to prepare a dispersion for charge generating layer. The dispersion was coated by a wire bar on each electroconductive support as described above, and dried at 80° C. for 15 minutes to prepare a charge generating layer with a film thickness of 0.15 μm.

Next, 10 parts of the hydrazone compound used in Example 13 and 10 parts of a bisphenol Z type polycarbonate (weight average molecular weight 39000) were dissolved in a solvent mixture of 40 parts of dichloromethane and 20 parts of monochlorobenzene, and the solution was coated by a wire bar on the charge generating layer as described above, followed by drying at 120° C. for 60 minutes to form a charge transporting layer with a film thickness of 25 μm.

Figure 12:
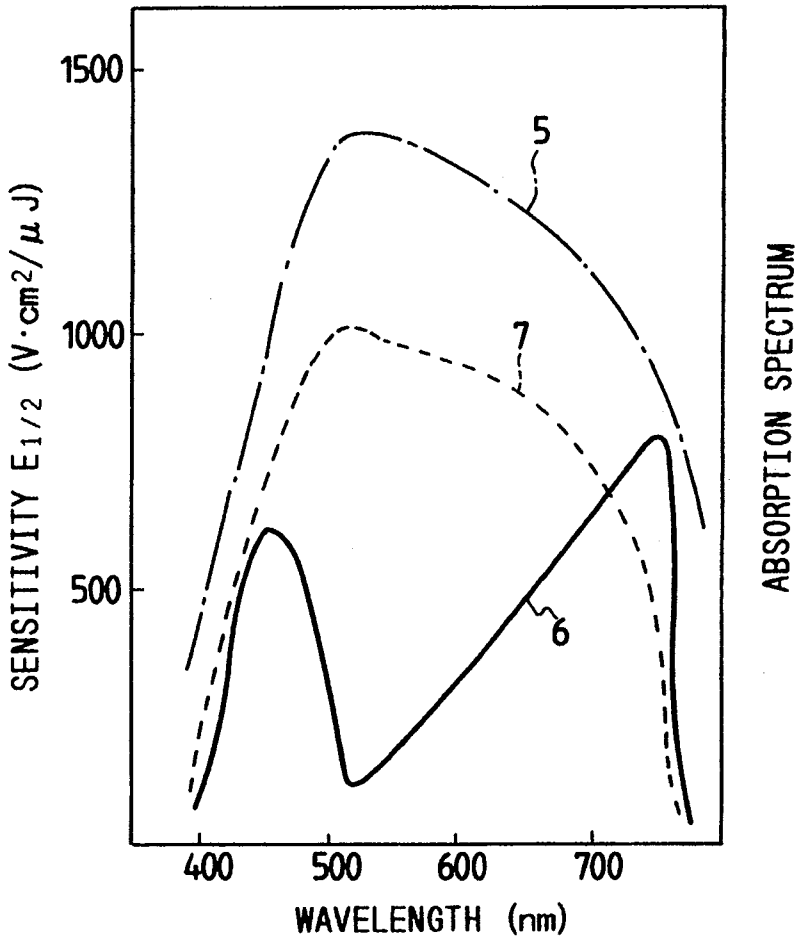

For the electrophotographic photosensitive member thus prepared, spectral sensitivity and dark decay were measured similarly as in Example 1. The results of the spectral sensitivity characteristic of Example 16 are shown in FIG. 12, and the results sensivitity ($E_{\frac{1}{2}}$) and dark decay (Δ Vdd) in Table 6.

Also, by means of a surface analyzer (Riken Keiki, Model AC-1), the work functions of tile charge generating material and each electroconductive support were measured. As the result, the work function of the charge generating material is 5.3 [eV] , and the work functions of the respective electroconductive supports are as shown in Table 6.

As can be seen from Table 6, n the combination having a difference of 0.5 [eV] or more in work function between the charge generating material and the electroconductive support, dark decay (Δ Vdd) is small, and it has a bi-peak type spectral sensitivity and also high sensitivity.

TABLE 1

| | Electroconductive support | | Work function difference between charge generating material and electroconductive support [eV] | $E_{\frac{1}{2}}$ Irradiation from the electroconductive layer side Monochromatic light 550 nm [μJ/cm²] | $E_{\frac{1}{2}}$ Irradiation from the charge transporting layer side Monochromatic light 680 nm [μJ/cm²] | Dark decay Δ Vdd [V] |
|---|---|---|---|---|---|---|
| | Material | Work function [eV] | | | | |
| Example 1 | Aluminum | 4.0 | 1.5 | 0.33 | 0.40 | 5 |
| Example 2 | Copper iodide | 4.7 | 0.8 | 0.35 | 0.42 | 5 |
| Example 3 | Tin oxide | 5.0 | 0.5 | 0.37 | 0.44 | 10 |
| Comparative Example 1 | Nickel | 5.3 | 0.2 | 0.57 | 0.74 | 50 |
| Comparative Example 2 | Platinum | 5.4 | 0.1 | 0.71 | 0.82 | 80 |

TABLE 2

| | Electroconductive support | | Work function difference between charge generating material and electroconductive support [eV] | $E_{\frac{1}{2}}$ Irradiation from the electroconductive layer side Monochromatic light 580 nm [μJ/cm²] | $E_{\frac{1}{2}}$ Irradiation from the charge transporting layer side Monochromatic light 700 nm [μJ/cm²] | Dark decay Δ Vdd [V] |
|---|---|---|---|---|---|---|
| | Material | Work function [eV] | | | | |
| Example 4 | Aluminum | 4.0 | 1.3 | 0.24 | 0.28 | 10 |
| Example 5 | Zinc | 4.6 | 0.7 | 0.25 | 0.30 | 10 |
| Example 6 | Indium oxide | 4.8 | 0.5 | 0.29 | 0.31 | 15 |
| Comparative Example 3 | Titanium oxide | 5.1 | 0.2 | 0.62 | 0.79 | 90 |
| Comparative Example 4 | Copper | 5.2 | 0.1 | 0.85 | 0.98 | 130 |

TABLE 3

| | Electroconductive support | | Work function difference between charge generating material and electroconductive support [eV] | $E_{\frac{1}{2}}$ Irradiation from the electroconductive layer side Monochromatic light 540 nm [μJ/cm²] | $E_{\frac{1}{2}}$ Irradiation from the charge transporting layer side Monochromatic light 650 nm [μJ/cm²] | Dark decay Δ Vdd [V] |
|---|---|---|---|---|---|---|
| | Material | Work function [eV] | | | | |
| Example 7 | Aluminum oxide | 3.8 | 1.3 | 0.28 | 0.30 | 10 |
| Example 8 | Indium | 4.1 | 1.0 | 0.29 | 0.30 | 15 |
| Example 9 | Lead | 4.3 | 0.5 | 0.30 | 0.31 | 15 |
| Comparative Example 5 | Gold | 4.9 | 0.2 | 0.51 | 0.65 | 65 |
| Comparative Example 6 | Tin oxide | 5.0 | 0.1 | 0.69 | 0.88 | 90 |

TABLE 4

| | Electroconductive support | | Work function difference between charge generating material and electroconductive support [eV] | $E_{\frac{1}{2}}$ [μJ/cm²] Monochromatic light 560 nm Irradiation from the electroconductive layer side | $E_{\frac{1}{2}}$ [μJ/cm²] Monochromatic light 560 nm Irradiation from the charge transporting layer side | Dark decay Δ Vdd [V] |
|---|---|---|---|---|---|---|
| | Material | Work function [eV] | | | | |
| Example 10 | Aluminum | 4.0 | 1.0 | 0.36 | 0.23 | 20 |
| Example 11 | Silver | 4.4 | 0.6 | 0.37 | 0.25 | 20 |
| Example 12 | Lead | 4.5 | 0.5 | 0.38 | 0.26 | 25 |
| Comparative Example 7 | Copper iodide | 4.8 | 0.2 | 0.40 | 0.39 | 120 |
| Comparative | Gold | 4.9 | 0.1 | 0.49 | 0.48 | 180 |

TABLE 4-continued

| | Electroconductive support | | Work function difference between charge generating material and electroconductive support [eV] | $E_{\frac{1}{2}}$ [μJ/cm²] Monochromatic light 560 nm Irradiation from the electroconductive layer side | Monochromatic light 560 nm Irradiation from the charge transporting layer side | Dark decay Δ Vdd [V] |
|---|---|---|---|---|---|---|
| | Material | Work function [eV] | | | | |
| Example 8 | | | | | | |

TABLE 5

| | Electroconductive support | | Work function difference between charge generating material and electroconductive support [eV] | $E_{\frac{1}{2}}$ Irradiation from the electroconductive layer side Monochromatic light 500 nm [μJ/cm²] | Irradiation from the charge transporting layer side Monochromatic light 650 nm [μJ/cm²] | Dark decay Δ Vdd [V] |
|---|---|---|---|---|---|---|
| | Material | Work function [eV] | | | | |
| Example 13 | Magnesium | 3.8 | 1.7 | 0.66 | 0.78 | 10 |
| Example 14 | Manganese | 4.4 | 1.1 | 0.70 | 0.80 | 10 |
| Example 15 | Tin oxide | 5.0 | 0.5 | 0.64 | 0.83 | 20 |
| Comparative Example 9 | Nickel | 5.3 | 0.2 | 1.11 | 1.42 | 75 |
| Comparative Example 10 | Platinum | 5.4 | 0.1 | 1.39 | 1.78 | 110 |

TABLE 6

| | Electroconductive support | | Work function difference between charge generating material and electroconductive support [eV] | $E_{\frac{1}{2}}$ Irradiation from the electroconductive layer side Monochromatic light 520 nm [μJ/cm²] | Irradiation from the charge transporting layer side Monochromatic light 750 nm [μJ/cm²] | Dark decay Δ Vdd [V] |
|---|---|---|---|---|---|---|
| | Material | Work function [eV] | | | | |
| Example 16 | Cadmium | 4.1 | 1.2 | 0.38 | 0.47 | 15 |
| Example 17 | Iron | 4.5 | 0.8 | 0.44 | 0.53 | 30 |
| Example 18 | Indium oxide | 4.8 | 0.5 | 0.47 | 0.61 | 40 |
| Comparative Example 11 | Antimony | 5.0 | 0.3 | 0.59 | 0.80 | 125 |
| Comparative Example 12 | Tellurium | 5.2 | 0.1 | 0.68 | 0.94 | 150 |

What is claimed is:

1. An electrophotographic photosensitive member comprising a light-transmissive electroconductive substrate having a first work function and a photosensitive layer on said substrate, said photosensitive layer comprising an organic charge generating material having a second work function and a charge transporting material having a third work function, wherein the difference between the first and second work function is 0.5 eV or more and is a value greater than the difference between the second and third work functions, whereby the number of the photoconductive carriers formed by said organic charge generating material and said substrate being more than the number of the photoconductive carriers formed by said organic charge generating material and said charge transporting material.

2. An electrophotographic photosensitive member according to claim 1, wherein said photosensitive layer has a charge generating layer and a charge transporting layer.

3. An electrophotographic photosensitive member according to claim 2, wherein said charge generating layer is a charge generating layer such that the product of the mobility of photoconductive carriers [cm²/V.sec] and the life of the photoconductive carriers [sec] is $1\times10^{-10}$ [cm²/V] or more.

4. An electrophotographic photosensitive member according to claim 3, wherein the product of the mobility of photoconductive carriers [cm²/V.sec] and the life of the photoconductive carriers [sec] is $1\times10^{-8}$ [cm²/V] or more.

5. An electrophotographic photosensitive member according to claim 1, wherein said photosensitive layer is a single layer.

6. An electrophotographic photosensitive member according to claim 5, wherein said photosensitive layer is a photosensitive layer such that the product of the mobility of photoconductive carriers [cm²/V.sec] and the life of the photoconductive carriers [sec]is $1\times10^{-10}$ [cm²/V ] or more.

7. An electrophotographic photosensitive member according to claim 6, wherein the product of the mobility of photoconductive carriers [cm²/V.sec] and the life of the photoconductive carriers [sec]is $1\times10^{-8}$ [cm²/V] or more.

8. An electrophotographic photosensitive member according to claim 1, wherein said electrophotographic photosensitive member has a bi-peak sensitivity.

9. An electrophotographic photosensitive member according to claim 1, wherein said substrate is shaped in sheet.

10. An electrophotographic photosensitive member according to claim 1, wherein said substrate is shaped in drum.

11. An electrophotographic photosensitive member according to claim 1, wherein said electrophotographic photosensitive member has an intermediate layer between said photosensitive layer and said substrate.

12. An electrophotographic photosensitive member according to claim 1, wherein said electrophotographic photosensitive member has a protective layer on said photosensitive layer.

13. An electrophotographic photosensitive member according to claim 1, wherein said electrophotographic photosensitive member is irradiated by image exposure light from said substrate side.

14. An electrophotographic photosensitive member according to claim 1, wherein said electrophotographic photosensitive member is irradiated by image exposure light from said photosensitive layer side.

15. An electrophotographic photosensitive member according to claim 1, wherein said electrophotographic photosensitive member is irradiated by image exposure light from said substrate side and also from said photosensitive layer side.

* * * * *

UNITED STATES PATENT AND TRADEMARK OFFICE

CERTIFICATE OF CORRECTION

PATENT NO. : 5,338,632

DATED : August 16, 1994

INVENTOR(S) : YUICHI HASHIMOTO, ET AL.

It is certified that error appears in the above-identified patent and that said Letters Patent is hereby corrected as shown below:

COLUMN 2

Line 45, "both." should read --two.--.
Line 55, "#or" should read --for--.

COLUMN 3

Line 31, "tile" should read --the--.
Line 32, "tile" should read --the--.

COLUMN 4

Line 61, "quirtone" should read --quinone--.

COLUMN 5

Line 30, "of" should be deleted.
Line 35, "as" should be deleted.

COLUMN 6

Line 16, "tile" should read --the--.

COLUMN 8

Line 31, "20parts" should read --20 parts--.
Line 57, "EXAMPLES 514 6" should read --EXAMPLES 5-6--.

COLUMN 13

Line 4, "tile" should read --the--.

UNITED STATES PATENT AND TRADEMARK OFFICE

CERTIFICATE OF CORRECTION

PATENT NO. : 5,338,632

DATED : August 16, 1994

INVENTOR(S) : YUICHI HASHIMOTO, ET AL.

It is certified that error appears in the above-identified patent and that said Letters Patent is hereby corrected as shown below:

COLUMN 14

Line 3, "n" should read --in--.

COLUMN 15

Line 49, "function" should read --functions--.

COLUMN 16

Line 53, "[sec]is" should read --[sec] is--.
Line 58, "[sec]is" should read --[sec] is--.
Line 65, "sheet" should read --sheet form--.
Line 68, "drum" should read --drum form--.

Signed and Sealed this

Twenty-ninth Day of August, 1995

Bruce Lehman

*Attest:*

BRUCE LEHMAN

*Attesting Officer*

*Commissioner of Patents and Trademarks*